US012680238B2

(12) United States Patent
Lindholm et al.

(10) Patent No.: US 12,680,238 B2
(45) Date of Patent: Jul. 14, 2026

(54) ASPHALT COMPACTOR STOP/START ASSIST

(71) Applicant: Caterpillar Paving Products Inc., Brooklyn Park, MN (US)

(72) Inventors: Timothy J. Lindholm, Ham Lake, MN (US); John L Marsolek, Watertown, MN (US); Cary M Bryant, Plymouth, MN (US); Jeremy W. Lee, Otsego, MN (US); Matthew D. Chisholm, Maple Grove, MN (US); Joseph A. Lehtola, Buffalo, MN (US); Robert J. McGee, Clayton, NC (US); Mark A. Tarvin, Canton, IL (US); Rianto A. Rahman, Plymouth, MN (US); Paul S. Petersen, Maple Grove, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 660 days.

(21) Appl. No.: 18/125,021

(22) Filed: Mar. 22, 2023

(65) Prior Publication Data

US 2024/0318388 A1 Sep. 26, 2024

(51) Int. Cl.
*E01C 19/23* (2006.01)
*E01C 19/28* (2006.01)

(52) U.S. Cl.
CPC ..... *E01C 19/235* (2013.01); *E01C 19/283* (2013.01); *E01C 19/288* (2013.01)

(58) Field of Classification Search
CPC ..... E01C 19/283; E01C 19/288
See application file for complete search history.

(56) References Cited

U.S. PATENT DOCUMENTS

| | | | | |
|---|---|---|---|---|
| 5,942,679 | A | 8/1999 | Sandstroem | |
| 7,086,806 | B2 | 8/2006 | Rickards | |
| 8,930,092 | B2 | 1/2015 | Minich | |
| 2015/0337505 | A1* | 11/2015 | Stallgies | E01C 19/48 404/118 |
| 2016/0244091 | A1* | 8/2016 | Oetken | E01C 19/23 |
| 2018/0030672 | A1* | 2/2018 | Marsolek | E01C 23/07 |
| 2019/0106846 | A1 | 4/2019 | Marsolek et al. | |
| 2020/0114957 | A1* | 4/2020 | Oetken | E01C 19/288 |
| 2021/0010210 | A1 | 1/2021 | Ellwein et al. | |
| 2021/0222379 | A1 | 7/2021 | Buschmann et al. | |
| 2023/0220645 | A1* | 7/2023 | Doy | E01C 19/282 404/133.05 |

FOREIGN PATENT DOCUMENTS

DE 102019002442 10/2020

* cited by examiner

*Primary Examiner* — Silvana C Runyan

(57) ABSTRACT

A system for assisting an asphalt compactor in performing a directional change can include a controller configured to perform a turn-out for the asphalt compactor by steering the asphalt compactor at a desired turning angle on an asphalt mat; the controller configured to turn off a vibratory system for the asphalt compactor during the turn-out; the controller configured to slow down and stop the asphalt compactor after a desired distance into the turn-out; and the controller configured to move the asphalt compactor in an opposite direction and restart the vibratory system.

20 Claims, 5 Drawing Sheets

ASPHALT COMPACTOR STOP/START ASSIST

TECHNICAL FIELD

This disclosure relates to road construction equipment, and more specifically to a compaction route plan for an asphalt compactor.

BACKGROUND

Compactors are machines used to compact initially loose materials, such as asphalt, soil, gravel, and the like, to a densified and more rigid mass or surface. Asphalt compactors travel behind a paver at a jobsite to compact an asphalt mat behind the paver. In addition to utilizing the weight of a roller drum to provide the compressive forces that compact the material, some compactors are configured to also induce a vibratory force to the surface.

In some examples, an automated compaction plan for the asphalt compactor can be developed based on inputting a method specification, which is created with the goal of achieving the desired compaction in the work area. Thus, the asphalt compactor can have a pre-determined route plan to perform. The route plan will typically require many directional changes.

However, there can be problems related to performing directional changes with asphalt compactors during compaction. Generally, if the operator does not perform directional changes correctly a defect (bump) is left behind during compaction asphalt. For example, when the asphalt compactor stops and then reverses, a divot is left in mat.

U.S. Pat. No. 5,942,679 discusses a system for documentation of the variables such as temperature, velocity, and position of an asphalt compactor as the asphalt compactor performs an operation.

SUMMARY

In an example according to this disclosure, a system for assisting an asphalt compactor in performing a directional change can include a controller configured to perform a turn-out for the asphalt compactor by steering the asphalt compactor at a desired turning angle on an asphalt mat; the controller configured to turn off a vibratory system for the asphalt compactor during the turn-out; the controller configured to slow down and stop the asphalt compactor after a desired distance into the turn-out; and the controller configured to move the asphalt compactor in an opposite direction and restart the vibratory system.

In another example, a method for controlling an asphalt compactor when changing directions can include automatically performing a turn-out of the asphalt compactor by steering the asphalt compactor at a desired turning angle on an asphalt mat; automatically turning off a vibratory system for the asphalt compactor during the turn-out; automatically slowing down and stopping the asphalt compactor after a desired distance into the turn-out; and automatically moving the asphalt compactor in an opposite direction and restarting the vibratory system.

In another example according to the present disclosure, an asphalt compactor can include a frame; a drum coupled to the frame for rolling over and compacting an asphalt mat; and a controller configured to perform a turn-out of the asphalt compactor by steering the asphalt compactor at a desired turning angle on the asphalt mat; the controller configured to turn off a vibratory system for the asphalt compactor during the turn-out; the controller configured to slow down and stop the asphalt compactor after a desired distance into the turn; and the controller configured to move the asphalt compactor in an opposite direction and restart the vibratory system.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
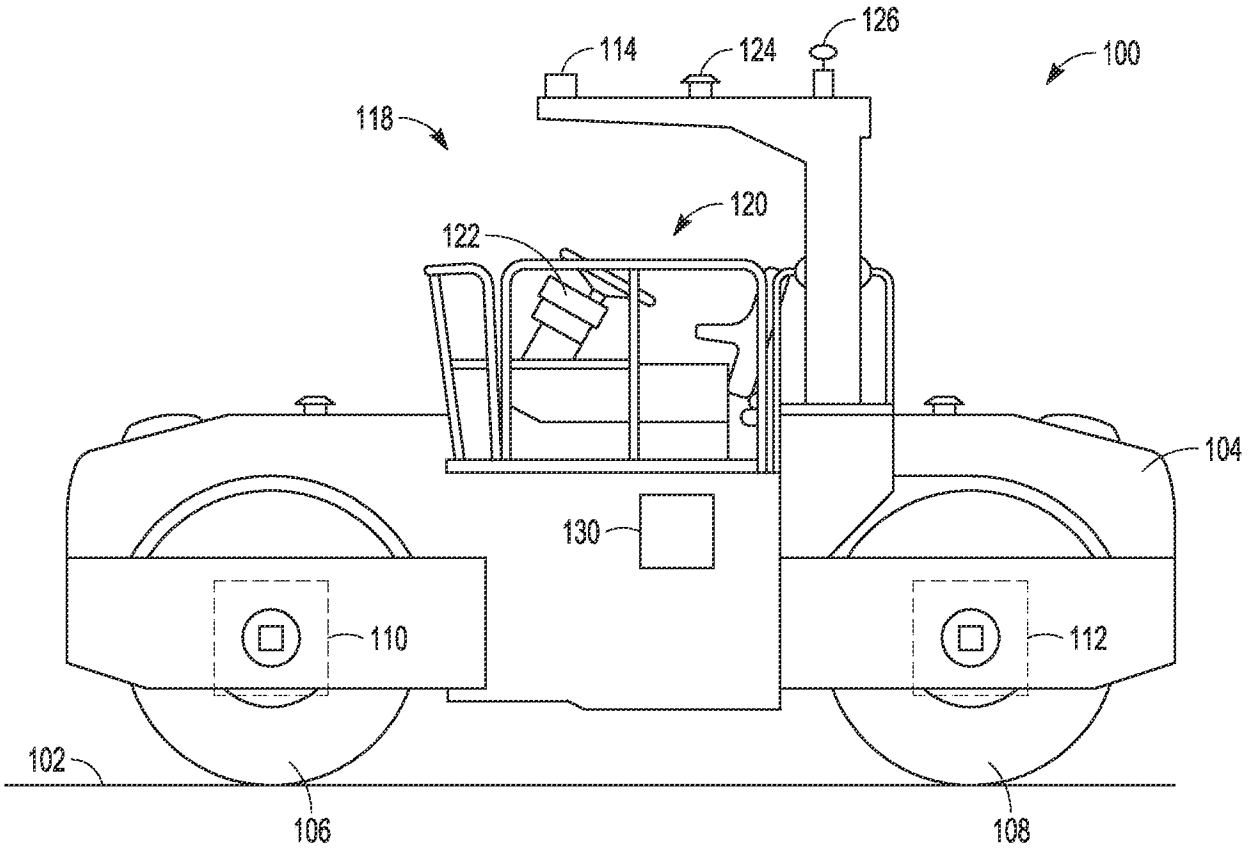
FIG. 1 shows a side view of an asphalt compactor, in accordance with one embodiment.

FIG. 1 shows a side view of an asphalt compactor 100, in accordance with one embodiment. The asphalt compactor 100 can be used, for example, for road construction, highway construction, parking lot construction, and other such paving and/or construction applications. The asphalt compactor 100 may make one or more passes over a worksite surface such as an asphalt mat 102 to provide a desired level of compaction.

The asphalt compactor 100 can include a frame 104, a first drum 106, and a second drum 108. The first and second drums 106, 108 may comprise cylindrical drums and/or other compaction elements of the asphalt compactor 100, and the first and second drums 106, 108 may be configured to apply vibration and/or other forces to the asphalt mat 102 in order to assist in compacting the asphalt mat 102. The first drum 106 and the second drum 108 may be rotatably coupled to the frame 104 so that the first drum 106 and the second drum 108 may roll over the asphalt mat 102 as the asphalt compactor 100 travels.

The first drum 106 may define a first central axis about which the first drum 106 may rotate, and similarly, the second drum 108 may define a second central axis about which the second drum 108 may rotate. The asphalt compactor 100 is shown as having first and second drums 106, 108. However, other types of asphalt compactors 100 may be suitable for use in the context of the present disclosure. For example, belted compaction machines or compaction machines having a single rotating drum, or more than two drums, are contemplated herein. Rather than a self-propelled asphalt compactor 100 as shown, the asphalt compactor 100 might be a tow-behind or pushed unit configured to couple with a tractor (not shown). An autonomous asphalt compactor 100 is also contemplated herein.

The asphalt compactor 100 can include a vibratory system. For example, the first drum 106 can include a first vibratory mechanism 110, and the second drum 108 may include a second vibratory mechanism 112. While FIG. 1 shows the first drum 106 having a first vibratory mechanism 110 and the second drum 108 having a second vibratory mechanism 112, in other embodiments only one of the first and second drums 106, 108 may include a respective vibratory mechanism 110, 112. Such vibratory mechanisms 110, 112 may be disposed inside the interior volume of the first and second drums 106, 108, respectively.

The asphalt compactor 100 may also include an operator station 118. The operator station 118 may include a steering system 120 including a steering wheel, levers, and/or other controls for steering and/or otherwise operating the asphalt compactor 100. In such examples, the various components of the steering system 120 may be connected to one or more actuators, a throttle of the asphalt compactor 100, an engine of the compaction machine, a braking assembly, and/or other such compaction machine components, and the steering system 120 may be used by an operator of the asphalt compactor 100 to adjust a speed, travel direction, and/or other aspects of the asphalt compactor 100 during use. The operator station 118 may also include a control interface 122 for controlling various functions of the asphalt compactor 100. The control interface 122 may comprise an analog, digital, and/or touchscreen display, and such a control interface 122 may be configured to display, for example, at least part of a travel path and/or at least part of a compaction plan of the present disclosure. The control interface 122 may also support other allied functions, including for example, sharing various operating data with one or more other machines (not shown) operating in consonance with the asphalt compactor 100, and/or with a remote server or other electronic device.

The asphalt compactor 100 can further be equipped with a plurality of machine sensors that can provide data indicative (directly or indirectly) of various operating parameters of the machine and/or the operating environment in which the machine is operating. The term "sensor" is meant to be used in its broadest sense to include one or more sensors and related components that may be associated with the asphalt compactor 100 and that may cooperate to sense various functions, operations, and operating characteristics of the machine and/or aspects of the environment in which the machine is operating. A sensor, such as LIDAR or a camera 114, can be located on the asphalt compactor 100 to provide information to a controller 130. For example, the LIDAR or camera 114 can include a thermal imaging camera or a thermal imaging process to allow the controller 130 to determine a width of the asphalt mat 102 and further to help determine the location of the asphalt compactor 100 relative to the asphalt mat 102.

The asphalt compactor 100 may further include a location sensor 124 connected at one or more locations on the frame 104. The location sensor 124 may be capable of determining a location of the asphalt compactor 100 and may include and/or comprise a component of a global navigation satellite system (GNSS). For example, the location sensor 124 may comprise a GNSS receiver, transmitter, transceiver or other such device, and the location sensor 124 may be in communication with one or more GNSS satellites to determine a location of the asphalt compactor 100 continuously, substantially continuously, or at various time intervals.

The asphalt compactor 100 may also include a communication device 126 configured to enable the asphalt compactor 100 to communicate with the one or more other machines, such as a paver, and/or with one or more remote servers, processors, or control systems located remote from the worksite at which the asphalt compactor 100 is being used. Such a communication device 126 may also be configured to enable the asphalt compactor 100 to communicate with one or more electronic devices located at the worksite and/or located remote from the worksite. In some examples, the communication device 126 may include a receiver configured to receive various electronic signals including position data, navigation commands, real-time information, and/or project-specific information. In some examples, the communication device 126 may also be configured to receive signals including information indicative of compaction specifications for the asphalt mat 102.

Such compaction specifications can include one or more of a machine speed, a number of passes, a vibration amplitude, a vibration frequency, an overlap between work lanes, a maximum number of passes, and the number of static (vibratory system off) passes to perform after a compaction target is reached. The specification is designed in order to complete the compaction of the asphalt mat 102 to a desired stiffness, density, and/or compaction of the asphalt mat 102.

The controller 130 can be in communication with the steering system 120, the control interface 122, the location sensor 124, the communication device 126, the camera 114, and/or other components of the asphalt compactor 100. The controller 130 may be a single controller or multiple controllers working together to perform a variety of tasks.

In one example, the controller 130 can be configured to generate a compaction plan, one or more travel paths for the asphalt compactor 100, and/or other information useful to an operator of the asphalt compactor 100. In some embodiments, the controller 130 may be positioned on the asphalt compactor 100, while in other embodiments the controller 130 may be positioned at an off-board location and/or remote location relative to the asphalt compactor 100. The present disclosure, in any manner, is not restricted to the type of controller 130 or the positioning of the controller 130 relative to the asphalt compactor 100.

The asphalt compactor 100 may be configured to be operated autonomously, semi-autonomously, or manually. When operating semi-autonomously or manually, the asphalt compactor 100 may be operated by remote control and/or by an operator physically located within the operator station 118.

As discussed, a compaction plan can be developed based on inputting a method specification, which is created with the goal of achieving the desired compaction in the work area. The compaction plan can include a path route which can include multiple direction changes. For example, the specification may require the asphalt compactor to go back and forth over a work lane multiple times. Also, the asphalt compactor will need to move to adjacent work lanes. While doing these actions, multiple directional changes are required.

However, as noted above, there can be problems related to performing directional changes with asphalt compactors during compaction. Generally, if the operator does not perform directional changes correctly a defect (bump) is left behind during compaction of asphalt. For example, when the asphalt compactor stops and then reverses, a divot is left in mat.

The present system provides a technique so that any divot is at an angle and not perpendicular to travel direction of vehicles that will later use the completed road surface. A perpendicular divot results in a washboard road surface. Thus, in the present system the asphalt compactor 100 is turned before stopping to avoid stopping perpendicular to a traffic direction. Also, the vibration system 110, 112 of the asphalt compactor 100 needs to be switched off prior to stopping of the asphalt compactor 100 or the directional change of the asphalt compactor 100.

As will be further detailed below, the present system generally provides a control system for the asphalt compactor 100 which is configured to perform directional changes autonomously. The directional changes can include stopping and starting of the vibration system, steering the asphalt compactor 100 to a correct angle, and stopping and starting of the asphalt compactor propel motion.

Figure 2:
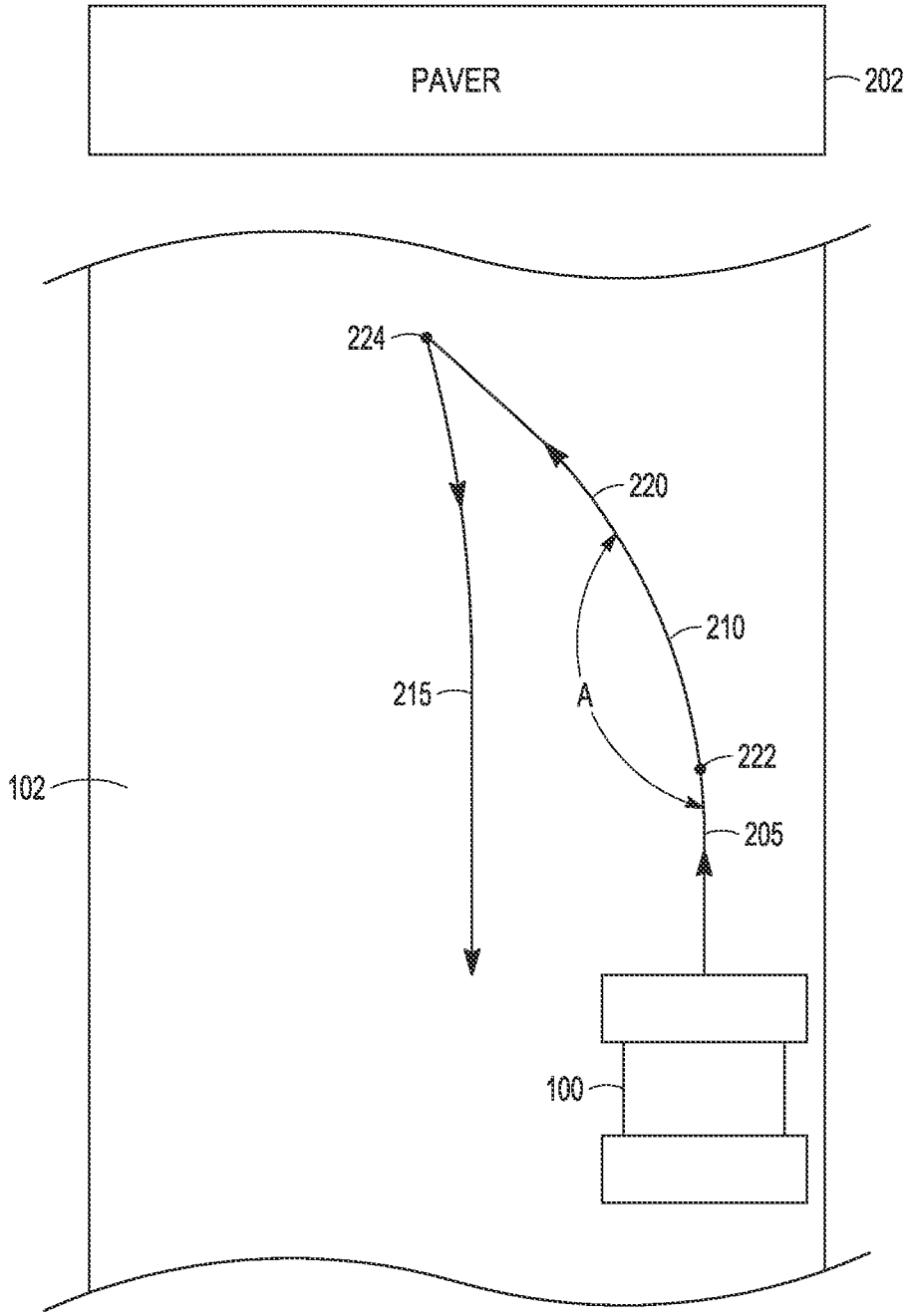
FIG. 2 shows atop, schematic view of a desired compacting path, in accordance with one embodiment.

Referring now also to FIG. 2, which shows a top, schematic view of a desired compacting path 210, in accordance with one embodiment, the controller 130 can be configured to perform a directional change from a first leg 205 of the compacting path 210 into a second leg 215 of the compacting path 210. The directional change includes a turning action including a turn-out 220 having an approximate starting point 222 and an ending point 224. In some examples, the asphalt compactor 100 is required to compact the same work lane more than once. Accordingly, in some examples the second leg 215 can follow the same line or path as the first leg 205.

The turn-out 220 of the compacting path 210 includes the asphalt compactor 100 being steered and turned at a desired turning angle (A) on the asphalt mat 102. The turning angle (A) can also be called a turn-out angle or turning path. As will be discussed, the turning angle (A) can be determined according to the width of the mat 102, the width of the asphalt compactor 100, and the relative location of the asphalt compactor 100 on the mat, among other factors. Information, such as mat width, can also be received from a paver 202 located in front of the asphalt compactor 100. The turning angle (A) can be held constant during the directional change operation or can vary with time, and any reference to the turning angle (A) encompasses both a constant angle and varying angles. For example, the angle (A) can range from about 25° to about 750° Typically, the angle (A) can be from about 330 to about 45°.

In performing the directional change, during the turn-out 220, the controller 130 can be configured to turn off the vibratory system for the asphalt compactor 100. Further, the controller 130 can be configured to slow the asphalt compactor 100 down at a pre-determined rate and stop the asphalt compactor 100 at the ending point 224 after a desired distance into the turn-out 220. Then the controller 130 can be configured to move the asphalt compactor 100 in an opposite direction down the second leg 215 and restart the vibratory system, if needed.

Figure 3:
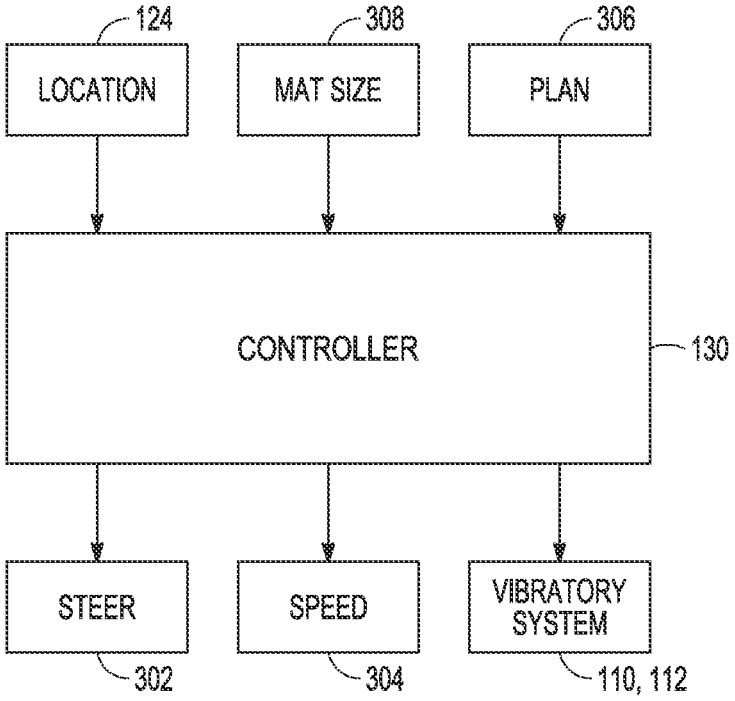
FIG. 3 shows a schematic representation of a control system for an asphalt compactor, in accordance with one embodiment.

Referring now also to FIG. 3 which shows a schematic representation of a control system for the asphalt compactor 100, in accordance with one embodiment, further details of the present system will be discussed.

As discussed above, the control system can include the controller 130 configured to assist the asphalt compactor 100 in performing a directional change.

One or more optional inputs to the controller 130 can include a location of the asphalt compactor 100, for example from the location sensor 124. Also, the controller 130 can receive or determine a size of the mat 308 from information received from the paver 202 or other means. Also, a route plan 306 can be input to the controller 130 or the route plan can be developed by the controller itself.

Based on the various input information, the controller 130 can then be configured to perform the turn-out by outputting signals to steer 302 the asphalt compactor 100, thus turning the asphalt compactor at a desired, pre-determined turning angle on an asphalt mat. The controller 130 can further control the speed 304, and the vibratory system 110, 112 of the asphalt compactor.

Accordingly, the controller 130 can be configured to slow down the asphalt compactor 100 at a pre-determined rate and stop the asphalt compactor after a desired distance into the turn-out, and then to move the asphalt compactor 100 in an opposite direction and restart the vibratory system, if needed.

In one example, the autonomous directional changes can be achieved by an operator selection of a desired turn-out angle and then manual activation of the automated process. Thus, the operator can manually enter the desired turning angle and then manually activate the turn-out.

In one embodiment, the directional change can be achieved by an automatic calculation by the controller 130 based on information obtained from the paver 202 (or from onboard sensors, such as LIDAR or camera 114) such as width of asphalt mat 102. Thus, the controller 130 can determine a proper turning angle and perform the turn-out entirely autonomously. Since, the controller 130 knows how wide the mat 102 is and the location of the compactor 100, the controller can determine the distance to go at a given angle to properly perform the direction change. Accordingly, in various embodiments, the controller can determine the turning angle and perform the turn-out after being triggered by at least one of initiation by an operator or autonomously by the asphalt compactor or by a remote system.

In some examples, the turning angle (A) and the desired distance to travel before stopping at the end point 224 can be determined based on a width of the asphalt mat 102 and a starting position of the asphalt compactor 100 on the asphalt mat 102.

As noted, the width of the asphalt mat 102 can be received from a paver 202 located in front of the asphalt compactor 100. In one example, the width of the asphalt mat 102 can be determined by the controller 130 itself based on sensor readings and thermal images received from the camera 114, for example. Further, the controller 130 can determine the relative location of the asphalt compactor 100 based on information received from the location sensor 124 and from the camera 114. Thus, the asphalt compactor 100 can be completely autonomous and perform the turn-out and directional change autonomously.

Figure 4:
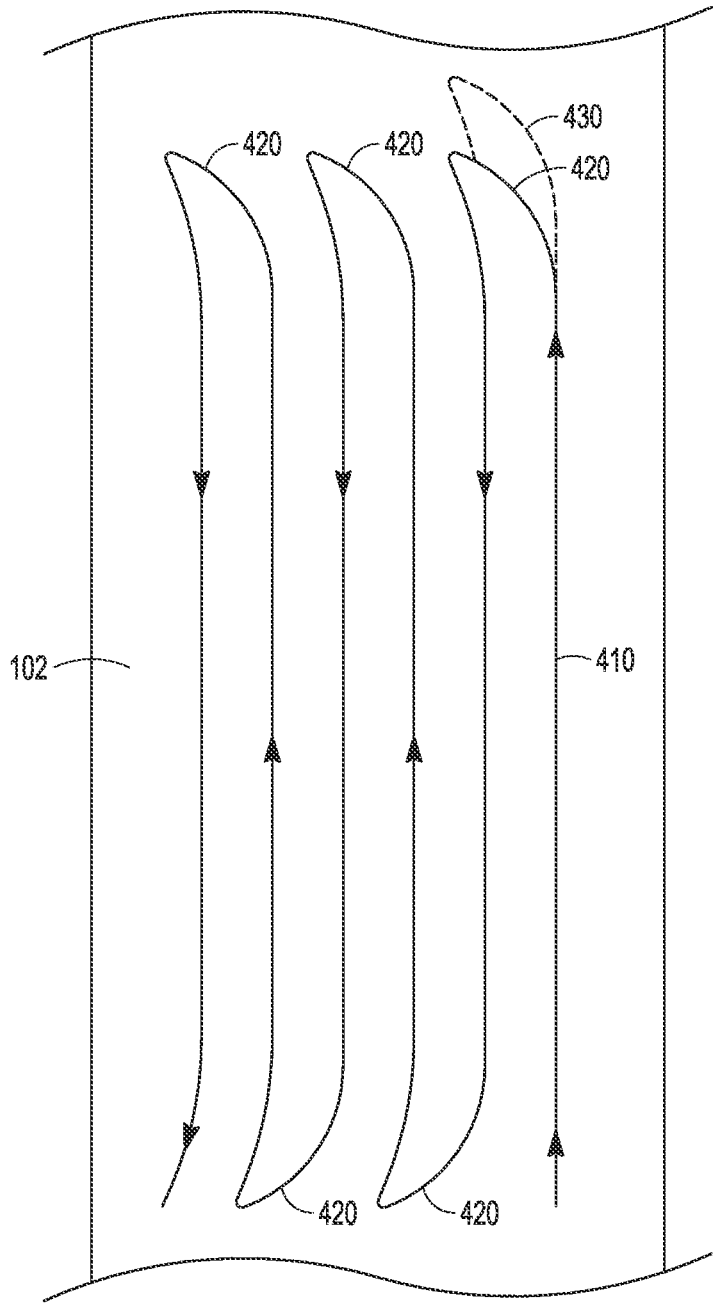
FIG. 4 shows atop view of an example compacting path, in accordance with one embodiment.

FIG. 4 shows atop view of an example compacting path 410, in accordance with one embodiment. The compacting path 410 can represent an entire pass planning route. The controller 130 can be configured to perform pass planning to provide a recommendation and/or automation of the full path compaction route 410 based on jobsite information such as a width of a paver screed located in front of the asphalt compactor, a speed of the paver, a width of the drum of the compactor, a number of compactors on a jobsite and any sensor feedback that helps determine the actual compaction level of the asphalt. Thus, the controller 130 can determine and perform a full path plan and then do turn-outs 420 and directional changes as needed.

In one example, the controller 130 can be configured to not use a turn out lane twice in the route 410. For example, if the pass planning requires the asphalt compactor to go over the same work lane more than once, the controller 130 can be configured to use different turn out lanes. For example, on a second pass, a second turn-out 430 can be utilized, different than the turn-out 420 (FIG. 4 shows only one second turn-out 430, but multiple such turnouts could be utilized).

INDUSTRIAL APPLICABILITY

The present system is applicable during many situations in road construction. For example, the present system can be used for asphalt compactors following a paver on an asphalt mat.

Figure 5:
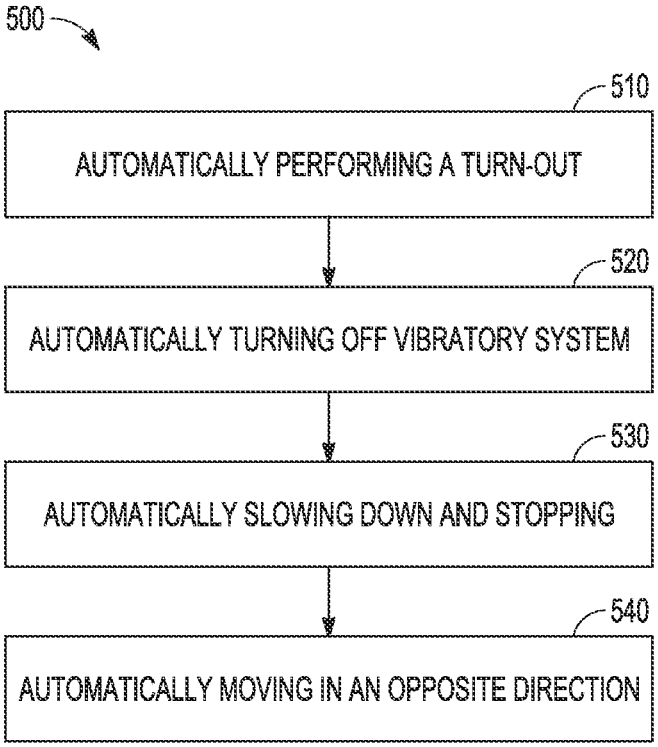
FIG. 5 shows a method for controlling an asphalt compactor, in accordance with one embodiment.

FIG. 5 shows a method (500) for controlling an asphalt compactor when changing directions, in accordance with one embodiment.

The method (500) can include automatically performing a turn-out (510) of the asphalt compactor by steering the asphalt compactor at a desired turning angle on an asphalt mat; automatically turning off a vibratory system (520) for the asphalt compactor during the turn-out; automatically slowing down and stopping (530) the asphalt compactor after a desired distance into the turn-out; and automatically moving the asphalt compactor in an opposite direction (540) and restarting the vibratory system.

As discussed above, in one example, the operator can manually enter the desired turning angle and then manually activate the automatic turn-out. In other example, the controller determines the turning angle and performs the turn-out autonomously.

As discussed, the turning angle and the desired distance to travel can be determined based on a width of the asphalt mat and a starting position of the asphalt compactor on the asphalt mat. In one example, the width of the asphalt mat can be received from a paver located in front of the asphalt compactor. In another example, the width of the asphalt mat can be determined by the controller based on thermal images or other sensor information. The starting position of the asphalt compactor can be determined using a location sensor such as a GNSS.

Accordingly the present system provides a method for controlling an asphalt compactor when the asphalt compactor needs to change its direction of travel requiring a turnout maneuver. The controller can determine a proper angle and distance to drive into the turn. The controller can turn off the vibratory system and begin turning the asphalt compactor and slowing the machine down. The controller can stop the machine and go the opposite direction in a new lane. In some examples requiring multiple passes for compaction, the same work lane can be driven over more than once.

In summary, the present disclosure relates to performing directional changes in asphalt compactors during compaction. As discussed, if the machine does not perform directional changes correctly a defect (bump) is left behind during compaction of asphalt. To avoid stopping perpendicular to a traffic direction, the compactor is required to be turned. Further, a vibration system of the compactor needs to be switched off prior to stopping of the compactor or the directional change.

More particularly, the present disclosure pertains to a machine control system in the asphalt compactor for performing directional changes autonomously. The directional changes include stopping or starting of vibration system, steering to a correct angle, and stopping or starting of the asphalt compactor propel motion. The autonomous directional changes can be achieved by a simple operator selection of a turn-out angle and manual activation of the automated process. Further, the directional change can be achieved by an automatic calculation based on information obtained from a paver such as width of asphalt mat. Moreover, the machine control system can perform pass planning to provide recommendation and automation of a full path compaction based on jobsite information such as paver screed width, paver speed, width, and quantity of compaction machines available, etc.

Various examples are illustrated in the figures and foregoing description. One or more features from one or more of these examples may be combined to form other examples.

The above detailed description is intended to be illustrative, and not restrictive. The scope of the disclosure should, therefore, be determined with references to the appended claims, along with the full scope of equivalents to which such claims are entitled.

What is claimed is:

1. A system for assisting an asphalt compactor in performing a directional change, the system comprising:

a controller configured to perform a turn-out for the asphalt compactor by steering the asphalt compactor at a desired turning angle on an asphalt mat;

the controller configured to turn off a vibratory system for the asphalt compactor during the turn-out;

the controller configured to slow down and stop the asphalt compactor after a desired distance into the turn-out; and the controller configured to move the asphalt compactor in an opposite direction and restart the vibratory system.

2. The system of claim 1, wherein an operator manually enters the desired turning angle and manually activates the turn-out.

3. The system of claim 1, wherein the controller determines the turning angle and performs the turn-out after being triggered by at least one of initiation by an operator or autonomously by the asphalt compactor or by a remote system.

4. The system of claim 1, wherein the turning angle and the desired distance to travel is determined based on a width of the asphalt mat and a starting position of the asphalt compactor on the asphalt mat.

5. The system of claim 4, wherein the width of the asphalt mat is received from a paver located in front of the asphalt compactor.

6. The system of claim 4, wherein the width of the asphalt mat is determined by the controller.

7. The system of claim 1, wherein the asphalt compactor is autonomous.

8. The system of claim 1, wherein the controller calculates an entire route to determine a full path for a compaction of the asphalt mat based on a determined mat width, a speed of the paver, a width of a drum of the asphalt compactor, and a number of compactors on a jobsite.

9. The system of claim 8, wherein the controller is configured to not use a turn out lane twice in the route.

10. A method for controlling an asphalt compactor when changing directions, the method comprising:

automatically performing a turn-out of the asphalt compactor by steering the asphalt compactor at a desired turning angle on an asphalt mat;

automatically turning off a vibratory system for the asphalt compactor during the turn-out;

automatically slowing down and stopping the asphalt compactor after a desired distance into the turn-out; and automatically moving the asphalt compactor in an opposite direction and restarting the vibratory system.

11. The method of claim 10, wherein an operator manually enters the desired turning angle and manually activates the turn-out.

12. The method of claim 10, wherein a controller determines the turning angle and performs the turn-out after being triggered by at least one of initiation by an operator or autonomously by the asphalt compactor or by a remote system.

13. The method of claim 10, wherein the turning angle and the desired distance to travel is determined based on a width of the asphalt mat and a starting position of the asphalt compactor on the asphalt mat.

14. The method of claim 13, wherein the width of the asphalt mat is received from a paver located in front of the asphalt compactor.

15. The method of claim 13, wherein the width of the asphalt mat is determined by the controller.

16. The method of claim 10, wherein a controller calculates an entire route to determine a full path for a compaction of the asphalt mat based on a determined mat width, a speed of the paver, a width of a drum of the compactor, and a number of compactors on a jobsite.

17. An asphalt compactor comprising:

a frame;

a drum coupled to the frame for rolling over and compacting an asphalt mat; and a controller configured to perform a turn-out of the asphalt compactor by steering the asphalt compactor at a desired turning angle on the asphalt mat;

the controller configured to turn off a vibratory system for the asphalt compactor during the turn-out;

the controller configured to slow down and stop the asphalt compactor after a desired distance into the turn-out; and the controller configured to move the asphalt compactor in an opposite direction and restart the vibratory system.

18. The compactor of claim 17, wherein an operator manually enters the desired turning angle and manually activates the turn-out.

19. The compactor of claim 17, wherein the controller determines the turning angle and performs the turn-out after being triggered by at least one of initiation by an operator or autonomously by the asphalt compactor or by a remote system.

20. The compactor of claim 17, wherein the turning angle and the desired distance to travel is determined based on a width of the asphalt mat and a position of the asphalt compactor on the asphalt mat.

* * * * *